US005268950A

United States Patent [19]

Vogelgesang et al.

[11] Patent Number: 5,268,950

[45] Date of Patent: Dec. 7, 1993

[54] SYSTEM AND METHOD FOR MAINTAINING UNIFORM SPACING OF AN ELECTRODE OVER THE SURFACE OF AN X-RAY PLATE

[75] Inventors: Peter J. Vogelgesang, St. Paul; Wayne M. Wirth, North St. Paul, both of Minn.

[73] Assignee: Minnesota Mining and Manufacturing Company, St. Paul, Minn.

[21] Appl. No.: 11,347

[22] Filed: Jan. 29, 1993

[51] Int. Cl.[5] ..... G03G 13/044

[52] U.S. Cl. ..... 378/29; 378/28; 378/31

[58] Field of Search ..... 378/28, 29, 33, 31

[56] References Cited

U.S. PATENT DOCUMENTS

| | | | |
|---|---|---|---|
| 4,176,275 | 11/1979 | Korn et al. | 250/213 R |
| 4,541,017 | 9/1985 | Feigt et al. | 378/28 |
| 4,961,209 | 10/1990 | Rowlands et al. | 378/29 |
| 5,125,013 | 6/1992 | Lubinsky et al. | 378/33 |

*Primary Examiner*—David P. Porta

*Attorney, Agent, or Firm*—Gary L. Griswold; Warren R. Bovee; Peter Forrest

[57] ABSTRACT

A conductive coating on a thin glass strip senses the image signal on a selenium coated photoimaging plate as the plate is scanned with a laser beam. The glass strip is suspended over the surface of the plate with finger-like members. The finger-like members that support the strip are spring loaded downward toward the plate, but are suspended above the plate by a pressurized cushion of air. The strip bends to assume the surface profile of the plate, thus maintaining uniform spacing even though the plate may not be flat and may even have a varying profile along its length.

7 Claims, 2 Drawing Sheets

SYSTEM AND METHOD FOR MAINTAINING UNIFORM SPACING OF AN ELECTRODE OVER THE SURFACE OF AN X-RAY PLATE

FIELD OF THE INVENTION

This invention relates to an x-ray image scanning device using a selenium photoconductor and a laser beam to develop a readout signal having a magnitude related to x-ray exposure. A plurality of support members permits a glass strip containing an electrode to maintain a uniform spacing above the surface of the photoconductor utilizing the offsetting forces of a pressurized air cushion and a resilient spring biasing mechanism.

BACKGROUND OF THE INVENTION

Various systems provide electrostatic imaging using charged photoreceptor plates which have been exposed to x-ray radiation to form latent x-ray images. The radiation sensitive imaging plates normally comprise conductive and insulative layers. A frequent selection of material for a conductive surface layer of the plates is selenium. The devices use the selenium as an active surface layer from which a focused laser beam is able to develop a readout signal having a magnitude related to x-ray exposure. This is accomplished by creating relative scanning motion between the laser output device, such as a conductively coated electrode strip, and the surface of the imaging plate.

The size of the plates used are often quite large, which requires lengthy conductive strips. A typical length of a strip, which is about equal to the width of the related photoconductor surface, is approximately 356 millimeters (14 inches). A typical length of an x-ray plate photoconductor is about 432 millimeters (17 inches). A glass strip electrode will scan slowly with a mechanical motion along the long axis of the x-ray plate, which is generally the vertical dimension of the x-ray image, while a focused laser beam scans at high speed along the shorter axis of the plate, which is the horizontal dimension of the image. The spacing between the strip and the photoconductor plate surface must be small to achieve optimum reproduction of the latent image.

One example of a multilayered imaging device and scanner is disclosed in U.S. Pat. No. 4,176,275 to Korn et al. In another example, U.S. Pat. No. 4,961,209 to Rowlands et al, a sensor electrode comprises a metal strip with a longitudinal slit to allow passage of a laser beam therethrough.

SUMMARY OF THE INVENTION

A device is provided for maintaining a scanner electrode at a uniform distance away from a conductive surface of a radiation imaging device. The device comprises flexible support means, resilient biasing means, and pneumatic supply means. The flexible support means holds a scanner electrode. The pneumatic supply means provides a pressurized air flow to a space between the flexible support means and the conductive surface of the radiation imaging device to partially offset the force of the resilient biasing means to maintain the scanner electrode at a uniform distance from the conductive surface substantially independent of any conductive surface plane abnormalities and debris.

A method is provided for maintaining a scanner electrode at a uniform distance away from a photoconductive surface of a radiation imaging device. The method provides an elongate scanner electrode suitable for sensing electrostatic imaging data stored in a photoconductive surface region of a radiation imaging device. The method includes supporting the scanner electrode at a plurality of locations using a plurality of flexible support means so that the scanner electrode is kept at a uniform distance from the conductive surface independent of any conductive surface plane abnormalities and debris.

DETAILED DESCRIPTION OF THE INVENTION

In an imaging system using a laser beam to sense electrostatic charges on a photoconductor surface, the importance of maintaining a minimum spacing between the sensing electrode and the photoconductor surface is well recognized. However, it is also particularly important that spacing be maintained uniformly and continuously during scanning. Obtaining this performance over a photoconductor surface having a width of many inches is virtually impossible using known scanning systems because of flatness and thickness variations in the photoconductor substrate, irregularities in the coating of the substrate, and debris on the substrate surface. Moreover, the holding mechanism for a photoconductor substrate may also cause distortion of the photoconductor surface. To achieve uniform and continuous spacing, parallelism should be maintained between the electrode and the surface of the imaging device i.e., the substrate. Lacking such parallelism, the readout signal varies with spacing variations causing undesired density artifacts in the reproduced x-ray image.

Previous efforts to achieve optimum spacing between a readout strip and an imaging surface, such as an x-ray plate, have focused on more precisely machining the respective components. However, even precisely machined components do not exhibit proper parallelism due to minute yet relevant irregularities on the x-ray plates, as well as due to distortion of readout strips related to the configuration of support mechanisms or other causes. This invention is designed to support a readout strip at several locations along its length, and to cause the strip to bend or accommodate to the minute changes in profile of an imaging surface as the strip and the imaging surface are moved relative to each other.

Figure 1:
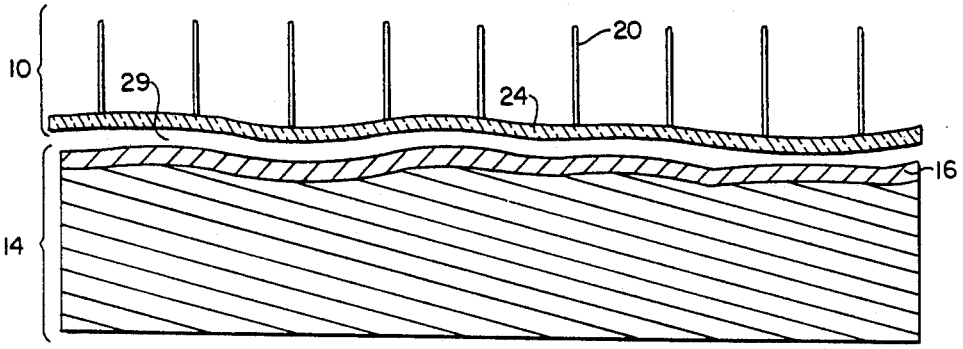
FIG. 1 is a simplified schematic front section view of the uniform spacing system illustrating the approximate manner in which the glass strip accommodates surface irregularities on the radiation imaging device conductive surface.
Figure 2:
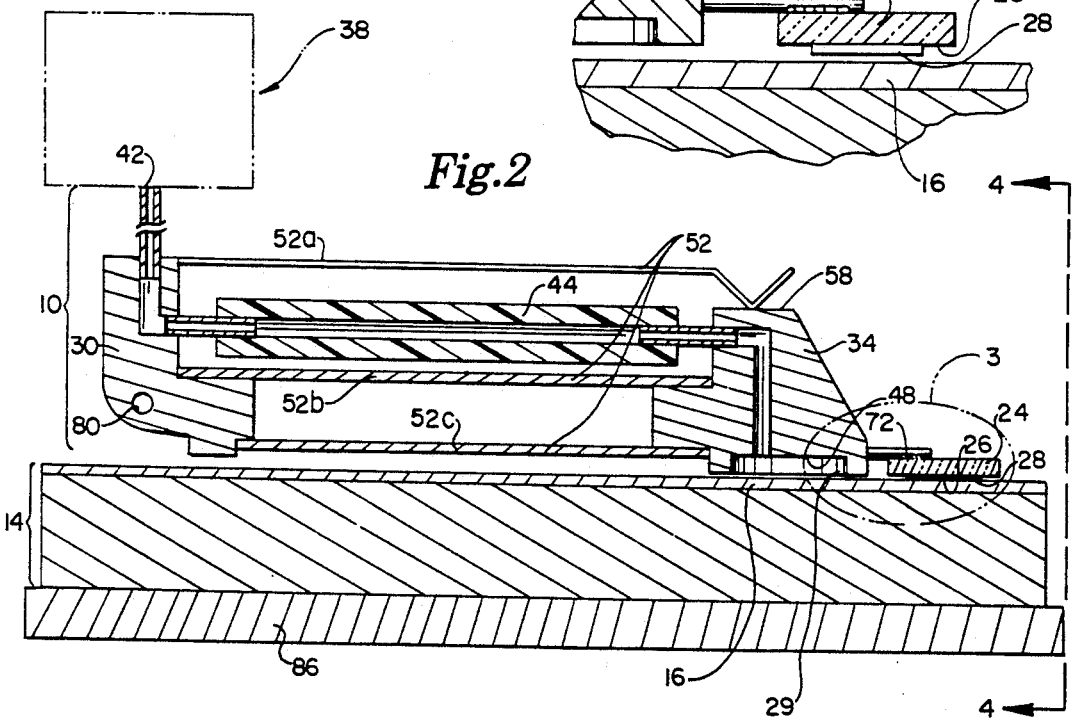
FIG. 2 is a side elevation sectional view of the uniform spacing system illustrating, in particular, the pneumatic control means for providing an air cushion between the flexible support means and the conductive surface being scanned.

FIG. 1 illustrates an enlarged front section schematic view of uniform spacing support system 10 shown configured above an imaging surface, such as an x-ray plate 14 having a conductive region or coating 16. In a preferred embodiment of the invention, conductive coating 16 comprises a selenium photoconductive coating, although other materials and coating structures are possible for use within the scope of this invention. Uniform spacing support system 10 comprises a plurality of suspension means 20 for suspending and supporting a non-conductive strip 24 during relative movement between non-conductive strip 24 and conductive coating 16. Suspension means 20 preferably comprises a plurality of finger-like assemblies, which will be further discussed below. Non-conductive strip 24 may be manufactured from a variety of materials, however, a preferred non-conductive strip 24 comprises a coated glass strip. In one embodiment, as shown in FIG. 2, a 0.5 millimeter glass strip 24, having bottom surface 26, comprises an attached electrode 28. Attached electrode 28 may comprise an electrically conductive coating that is transparent at desired wavelengths. One example of an acceptable coating is a vacuum deposited layer of indium tin oxide.

In FIG. 1, suspension means 20 is spaced along strip 24. Suspension means 20 comprises a plurality of individual self-adjusting members or assemblies for positioning portions of strip 24. Then, with the creation of a pressurized air cushion in the space 29 the shape of strip 24 becomes substantially conformal to the surface shape or irregularity pattern of conductive coating 16, or debris thereon, while maintaining a desired separation distance.

Figure 3:
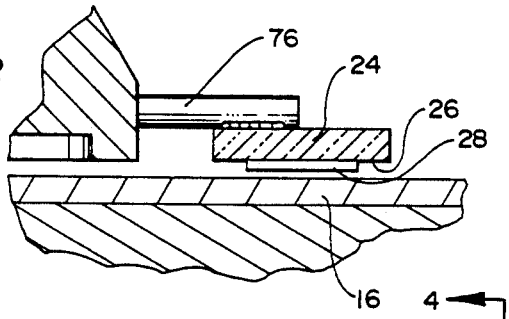
FIG. 3 is an enlarged view of a portion 3 of FIG. 2.

FIG. 2 and FIG. 3 each disclose a more specific depiction of one embodiment of the invention in which uniform spacing support system 10 is configured to support and position strip 24 at several points along its length. This permits the strip to bend to the surface profile of coating 16 of x-ray plate 14 as strip 24 is relatively moved along the length of the x-ray plate. This also allows strip 24, bottom surface 26, and electrode 28 to be maintained at a uniform spacing above the surface profile of coating 16. Uniform spacing support system 10 preferably comprises support member 30, head assembly 34, pneumatic supply means 38 for providing an air cushion to maintain separation between strip 24 and x-ray plate 14, and resilient biasing means 52 for biasing head assembly 34 toward x-ray plate 14.

Pneumatic supply means 38 comprises air input structure 42 for receiving an air supply and routing that supply through flexible air coupling 44, and through head assembly 34 to an air cushion chamber defined by chamber walls 48. Air cushion chamber walls 48 shape and direct an air cushion onto the surface of x-ray plate 14. The air cushion is regulated by pneumatic supply means 38 so that head assembly 34 and electrode 28 are positioned above surface 16 at the desired distance to achieve optimum image sensing.

Resilient biasing means 52 preferably comprises upper leaf spring 52*a*, middle leaf spring 52*b*, and lower leaf spring 52*c*, although other biasing means configurations are possible within the scope of this invention. In the embodiment disclosed in FIG. 2, springs 52*b*, 52*c* comprise parallel leaf springs constructed to provide mounting of head assembly 34 to support member 30 so that head assembly 34 may move vertically, normal to the surface comprising conductive coating 16, but in no other direction. Spring 52*a* biases against the top portion 58 of head assembly 34 to force head assembly 34 and strip 24 downward proximate x-ray plate surface coating 16. The pressurized air cushion regulates the separation of the strip from the plate. A preferred separation distance is approximately 0.051 millimeters (0.002 inches). The pressurized air then escapes between x-ray plate surface coating 16 and the strip/electrode bottom surface. This provides yet another advantage in cleaning away small debris which might otherwise create undesired sensing errors.

Figure 4:
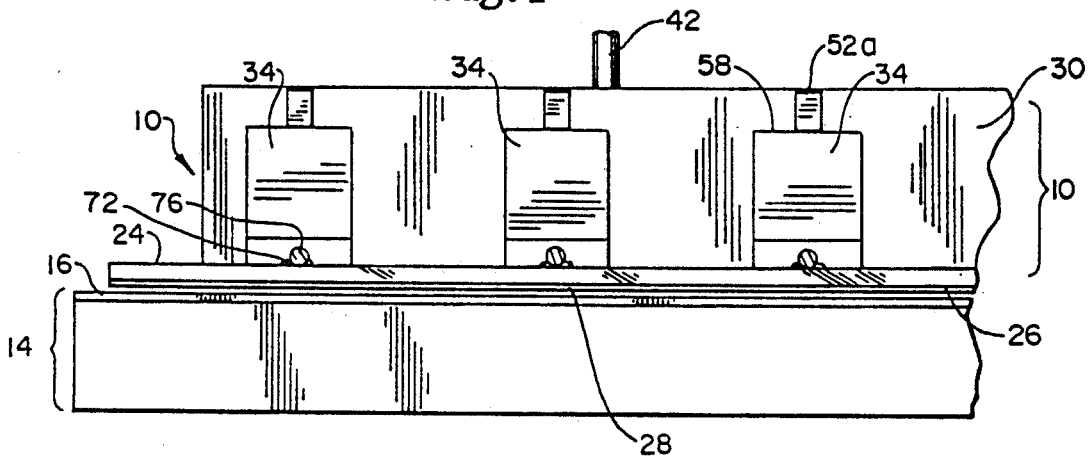
FIG. 4 is a front elevation view of the uniform spacing system.

FIG. 4 is a front elevation view of a section of uniform spacing support system 10 and x-ray plate 14 showing the arrangement of head assemblies 34 providing support and positioning of strip 24. FIG. 4 illustrates the operation of uniform spacing support system 10 which positions strip 24 and electrode 28 over surface coating 16 of x-ray plate 14. This permits the shape of strip 24 to conform to the shape of surface coating 16 as scanning occurs.

Figure 5:
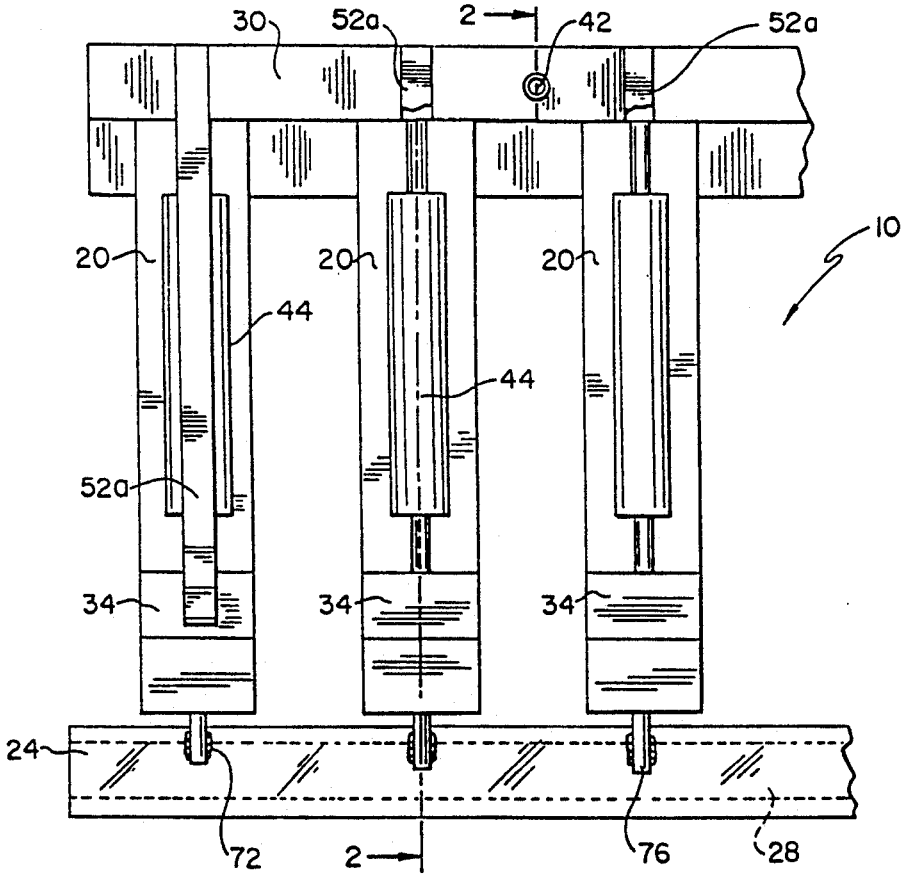
FIG. 5 is a top plan view of a portion of the uniform spacing system without an x-ray plate beneath.

FIG. 5 is a top view of a plurality of suspension means 20, which are each spaced at approximately 25 mm centers although other spacing is feasible. Each suspension means 20 comprises head assembly 34 to which glass strip 24 adheres. A flexible adhesive or bonding agent 72, such as a silicone cement, is utilized so that glass strip 24 is nominally free to bend and rotate about the axis of glass mounting pin 76. A strengthening member (not shown) may be optionally provided to restrict the motion of suspension means 20 so that glass strip 24 cannot be fractured by excessive motion. FIG. 5 illustrates only one upper leaf spring 52*a*, although in actual use there is likely to be at least one upper leaf spring 52*a* for each head assembly 34.

Support member 30 is configured for rotation on a shaft 80, shown in FIG. 2, or similar means for rotating uniform spacing support system 10 away from plate 14. In this way, the entire support system 10 may be lifted or rotated out of the way of an inserted x-ray plate 14. All sequences in the loading and unloading of x-ray plate 14 are preferably interlocked so that glass strip 24 cannot physically touch surface coating 16 and possibly damage glass strip 24. Once x-ray plate 14 is inserted into the system, for example on top of system mounting surface 86, pneumatic control means 38 is activated. Then, support member 30 is positioned to allow suspension means 20, and more particularly head assemblies 34, to come to rest on air cushions slightly above surface coating 16. This sequence permits fine mechanical precision in the system to be controlled after an x-ray plate is inserted, rather than pre-inserting estimated mechanical adjustments based on unknown or poorly defined x-ray plate irregularities. As x-ray plate 14 is moved during scanning, strip 24 rises and falls along its length to follow the surface profile of plate 14.

Successful operation of spacing support system 10 greatly depends upon accurate control of air supply and the precise, adaptable suspension of glass strip 24. Testing of system 10 revealed that certain locations of suspension means 20 require relatively increased or decreased volumes of air flow to achieve uniform spacing according to the invention. A plurality of air input structures 42 may be desirable. Air input structures may include isolation means within associated ducting to provide specific air flow volumes to certain suspension means 20 that is different from the air flow volumes to other suspension means.

A preferred method of fabrication and adjustments to spacing support system 10 comprises a lapping process to ensure that all of the surfaces of suspension means 20 are flat and parallel. In order to achieve this objective, the suspension means, without glass strip 24 cemented to them, are brought into physical contact with a heavy glass plate wetted with lapping compound. The plate and the suspension means are then oscillated to cause the surface of the suspension means to grind away and fit to the surface of the grinding plate. Upon completion of grinding, the glass strip 24 and the suspension means 20 are placed on a flat surface to ensure a co-planar relation. Silicone cement 72 is then applied to mounting pins 76 to support glass strip 24. Therefore, when brought down into close contact with surface coating 16 of selenium x-ray plate 14, the spacing of glass strip 24 above plate 14 is equal to the thickness of the air cushion between under-surfaces of suspension means 20 and the top surface coating 16 of x-ray plate 14.

We claim:

1. A device for maintaining a scanner electrode at a uniform distance away from a photoconductive surface of a radiation imaging device, comprising:

a) flexible support means for holding a scanner electrode;

b) resilient biasing means for biasing the flexible support means toward a conductive surface of a radiation imaging plate; and c) pneumatic supply means for providing pressurized air flow to a space between the flexible support means and the conductive surface of the radiation imaging device to partially offset the force of the resilient biasing means to maintain the scanner electrode at a uniform distance from the conductive surface substantially independent of any conductive surface plane abnormalities and debris.

2. The device of claim 1 in which the flexible support means comprises a non-conductive substrate material that is transparent at a wavelength of operation of the imaging device.

3. The device of claim 2 in which the flexible support means comprises a glass strip.

4. The device of claim 3 in which each of the flexible support means comprises a head assembly having a protruding pin suitable for adhesion to the glass strip.

5. The device of claim 4 in which the glass strip is free to bend and rotate about a longitudinal axis of the protruding pin.

6. The device of claim 1 in which the scanner electrode comprises a conductive coating which is transparent at a wavelength of operation of the imaging device.

7. A method for maintaining a scanner electrode at a uniform distance away from a photoconductive surface of a radiation imaging device, comprising the steps of:

a) providing an elongate scanner electrode suitable for sensing electrostatic imaging data stored in a photoconductive surface region of a radiation imaging device; and b) supporting the scanner electrode at a plurality of locations using a plurality of flexible support means each comprising biasing means and pneumatic control means so that the scanner electrode is kept at a uniform distance from the conductive surface independent of any conductive surface plane abnormalities and debris.

* * * * *